United States Patent [19]

West et al.

[11] Patent Number: 4,745,379

[45] Date of Patent: May 17, 1988

[54] LAUNCHER-LESS AND LUMPED CAPACITOR-LESS CERAMIC COMB-LINE FILTERS

[75] Inventors: James B. West, Cedar Rapids; James C. Cozzie, Ely, both of Iowa

[73] Assignee: Rockwell International Corp., El Segundo, Calif.

[21] Appl. No.: 19,398

[22] Filed: Feb. 25, 1987

[51] Int. Cl.[4] ..... H01P 1/205; H01P 7/04

[52] U.S. Cl. ..... 333/206; 333/202; 333/222; 333/245

[58] Field of Search ..... 333/202, 203, 205, 206, 333/207, 219, 222, 223, 204, 231, 235, 208–212, 245, 248

[56] References Cited

U.S. PATENT DOCUMENTS

| | | | |
|---|---|---|---|
| 4,179,673 | 12/1979 | Nishikawa et al. | 333/204 |
| 4,268,809 | 5/1981 | Makimoto et al. | 333/202 |
| 4,410,868 | 10/1983 | Meguro et al. | 333/202 |
| 4,431,977 | 2/1984 | Sokola et al. | 333/202 X |
| 4,464,640 | 8/1984 | Nishikawa et al. | 333/202 |
| 4,523,162 | 6/1985 | Johnson | 333/202 |
| 4,546,333 | 10/1985 | Fukasawa et al. | 333/223 |
| 4,673,902 | 6/1987 | Takedal et al. | 333/202 |

FOREIGN PATENT DOCUMENTS

| | | | |
|---|---|---|---|
| 0254802 | 12/1985 | Japan | 333/202 |

OTHER PUBLICATIONS

"Comb-line Bandpass Filters of Narrow or Moderate Bandwidth", by George L. Matthaei, Aug. 1963, *Microwave Journal*, pp. 82–91.

"Analysis and Composition of a New Microwave Filter Configuration with Inhomogeneous Dielectric Medium", by A. Fukasawa, *IEEE Trans. on Microwave Theory and Techniques*, vol. MTT-30, No. 9, Sep. 1982, pp. 1367–1375.

"Cermaic-Filled Resonator Cuts Costs of Radio-Telephone Filters", by T. Uwano, Jul. 14, 1983, *Electronics*, vol. 56:129–131.

*Microwave Filters Impedance Matching Networks and Coupling Structures*, by G. L. Matthaei et al., McGraw Hill Book Co., N.Y., N.Y., 1964, Sections 8.13 and 8.14.

*Microwave Filters Impedance Matching Networks and Coupling Structures*, by G. L. Matthaei et al., McGraw Hill Book Co., N.Y., N.Y., 1964, Sections 12.01–12.07.

*Primary Examiner*—Marvin L. Nussbaum

*Attorney, Agent, or Firm*—Gregory G. Williams; M. Lee Murrah; H. Fredrick Hamann

[57] ABSTRACT

An inhomogeneous ceramic dielectric microwave RF TEM resonator filter having a plurality of unplated notches in the ceramic for enhancing direct inter-resonator coupling. The filter is implemented without the lumped coupling capacitors which are typically associated with each resonator of a TEM resonator filter. Furthermore, the launching resonators which are typically used to couple in and out of the filter are eliminated by using coaxial probe capacitors inserted in each of the end resonators. The non-end resonators can be made to look as long as the end resonators, with probes therein, by including a conductor pad disposed upon the block top surface and connecting the internal plating of the non-end resonators.

1 Claim, 2 Drawing Sheets

PRIOR ART
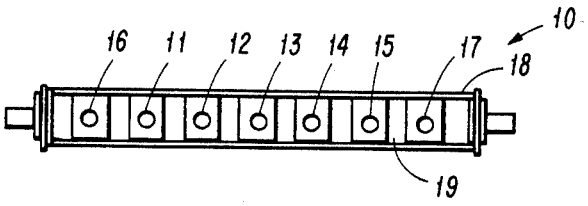
FIG 1
FIG 2
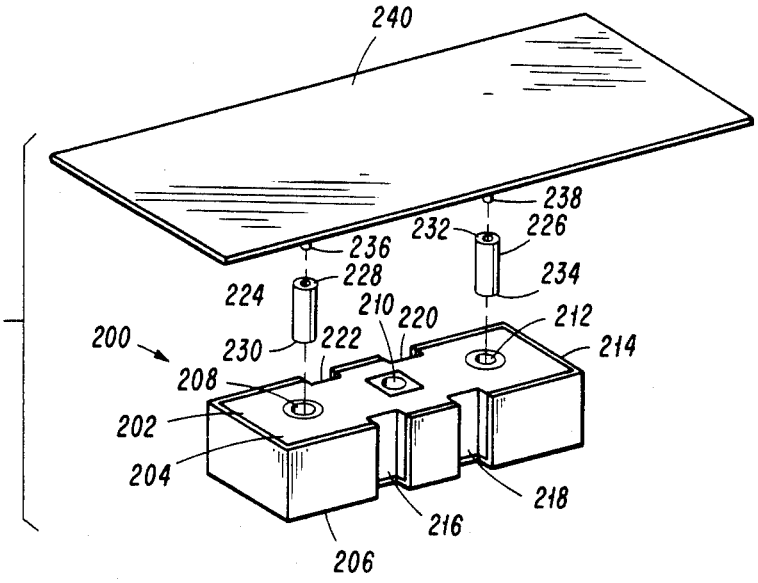
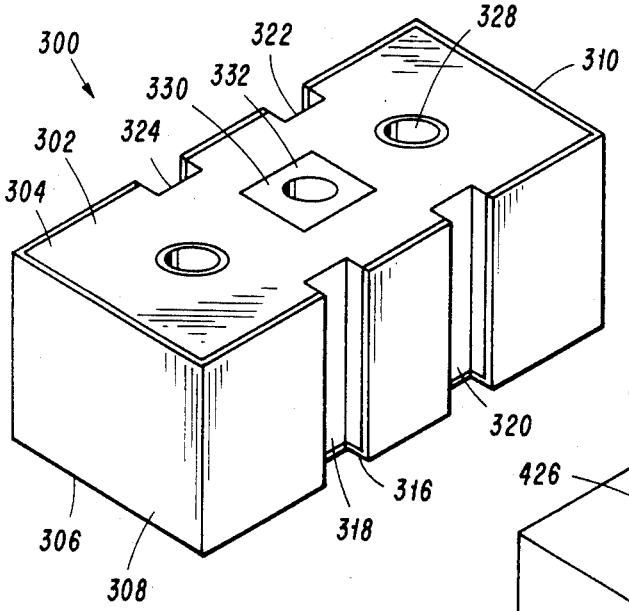
FIG 3
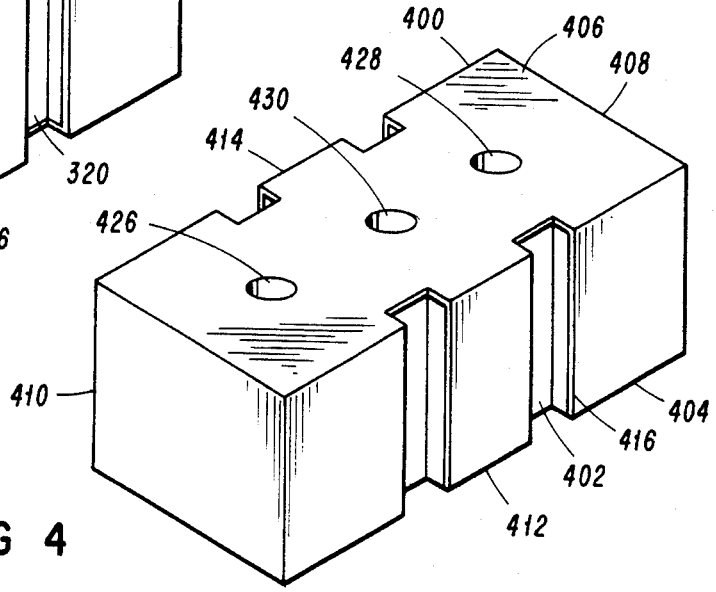
FIG 4

LAUNCHER-LESS AND LUMPED CAPACITOR-LESS CERAMIC COMB-LINE FILTERS

BACKGROUND OF THE INVENTION

CROSS-REFERENCE TO RELATED APPLICATIONS

This application relates to the subject matter of copending applications by James B. West entitled "Ceramic TEM Bandstop Filter", filed on even date herewith and assigned to the same assignee, the serial number of which is 07/019,400; and "Ceramic TEM Resonator Bandpass Filters with Varactor Tuning", also filed on even date herewith and assigned to the same assignee, the serial number of which is 07/019,399; and the subject matter of both of those applications is hereby incorporated by reference.

FIELD OF THE INVENTION

The present invention generally relates to microwave RF filters, and more particularly, is concerned with ceramic comb-line microwave RF filters.

In recent years, there has been a significant desire among microwave RF engineers to reduce the overall size and the circuit board attachment surface area of comb-line filters. These filters find many uses throughout the microwave RF industry, with uses as low-loss preselector bandpass filters being exemplary of the countless other applications. In such applications, it is often much desired to allow only a certain range of frequencies, usually a narrow bandpass, to continue from the broadband of an antenna to the narrowband of a typical microwave receiver while concomitantly having a very small degree of signal strength loss in the passband.

One method of bandpass filter construction which has been used to meet the needs of microwave RF engineers is described and illustrated in the renowned treatise, "Microwave Filters, Impedance-Matching Networks, and Coupling Structures" by George L. Matthaei, Leo Young, and E. M. T. Jones, which was published by McGraw Hill Book Company of New York, NY, in 1964. Sections 8.13 and 8.14 of this work are herein incorporated by this reference. The air dielectric filters as disclosed therein have been used to perform the bandpass filtering function in the past. With the current trend toward miniaturization, however, ceramic materials are beginning to replace the traditional air dielectrics in such filters.

Another method of bandpass filter construction has been attempted, and is described and illustrated in the article entitled "Analysis and Composition of a New Microwave Filter Configuration with Inhomogeneous Dielectric Medium" by Atsushi Fukasawa in Volume MTT-30, No. 9, Sept. 1982, of the IEEE Transactions on Microwave Theory and Techniques, which is incorporated herein by this reference. Fukasawa uses several resonators, each surrounded by a ceramic dielectric, which are held in a separated position from each other by a common framework mechanism.

While these systems, or variations of them, have been used extensively for filtering microwave RF signals, they do have numerous serious drawbacks. One major problem with the classic comb-line filter having a air dielectric is the overall size and surface area occupied by such a filter on a circuit board is often very undesirable. Another drawback with these filters is the frequent need for lumped tuning capacitors. These capacitors introduce problems in a filter structure because the characteristic impedance of a ceramic filter resonator is about 1/6 the impedance of a typical resonator with air dielectric. This requires a capacitor of high value to tune the resonator. The adjustments of such a capacitor often disturbs the coupling coefficient of the resonators and increases the difficulty of tuning the filter. In addition, the external capacitor is subject to drift during the filter lifetime. A major drawback of a ceramic filter of the Fukasawa design is its overall size and surface area, albeit smaller than the typical air dielectric filter. Another drawback of the Fukasawa design is its need for a framework mechanism to hold the individual resonators in their desired position. This framework makes the device more cumbersome and difficult to manage. Yet another drawback of the Fukasawa design is the need for launching resonators for coupling the filter with other circuit elements. Finally, another drawback of Fukasawa is the difficulty and expense of integrating such a filter to a circuit board.

Consequently, a need exists for improvement in comb-line microwave RF filters which will result in an overall size and attachment surface area reduction, easier and cheaper integration ability to circuit boards, and the easier ability to initially tune the filter.

SUMMARY OF THE INVENTION

It is an object of the present invention to reduce the overall size and surface area of microwave RF filters.

It is a feature of the present invention to eliminate the launching resonators which are typically located at each end of the several aligned resonators by providing an electrical probe for producing coaxial capacitance in the resonator found at each end of the series of resonators.

It is an advantage of the present invention to eliminate the need for a parallel plate capacitor to be formed on the surface of the resonant filter.

It is an object of the present invention to provide a single unit microwave RF resonator filter which eliminates the need for lumped capacitors associated with each resonator.

It is a feature of the present invention to provide a plurality of unplated notches through the typical conductive plating around the overall ceramic dielectric.

It is an advantage of the present invention to eliminate the need for top lumped capacitors associated with each resonator and concomitantly eliminate the need for a framework to separate the several resonators.

The present invention provides a ceramic comb-line resonator filter designed to satisfy the aforementioned needs, produce the above-described objects, include the previously-discussed features, and achieve the disclosed advantages. A microwave RF signal is filtered by a "launcher-less" and "lumped capacitor-less" single unit resonator filter in the sense that the end launcher resonators typically found in comb-line filters have been eliminated while also the typical lumped capacitors associated with each transverse electromagnetic (TEM) resonator of a comb-line filter are also eliminated in a monolithic resonator filter. Instead, an input and output coaxial capacitance is achieved by inserting an electrical probe in each of the end TEM resonators. Interresonator coupling is provided by a plurality of unplated notches in the typical metallic plating which is formed upon all but the top surface of the ceramic material. Since the resonator lengths are very nearly $\frac{1}{4}$ wavelength, electromagnetic coupling is not possible without the introduction of the inhomogeneity of the unplated notches. Furthermore, despite the need for two electrical probes to be inserted into the end resonators, the top surface of the ceramic/resonator combination is free from plating necessary to produce capacitance, thereby allowing for increased adaptability of the filter to a circuit board. Also, the ease of manufacture and the ease for initial tuning is enhanced by the filter of this invention.

Accordingly, the present invention relates to an apparatus and method for filtering microwave RF signals, which include a comb-line filter having a ceramic dielectric therein and further having a plurality of unplated notches through the metallic plating on the ceramic and a capacitor probe positioned inside the last resonator on each end of the comb-line filter.

BRIEF DESCRIPTION OF THE DRAWINGS

The invention will be best understood by a reading of the description in conjunction with the drawings, in which:

FIG. 1 is a top view of a multifarious inhomogeneous dielectric filtering apparatus of the prior art;

FIG. 2 is an exploded schematic diagram of a monolithic inhomogeneous ceramic filter of the present invention;

FIG. 3 is an enlarged perspective view of the top and side of a monolithic inhomogeneous ceramic filter of the present invention;

FIG. 4 is an enlarged perspective view of the bottom and side of a monolithic inhomogeneous ceramic filter of the present invention.

DETAILED DESCRIPTION

Figure 5:
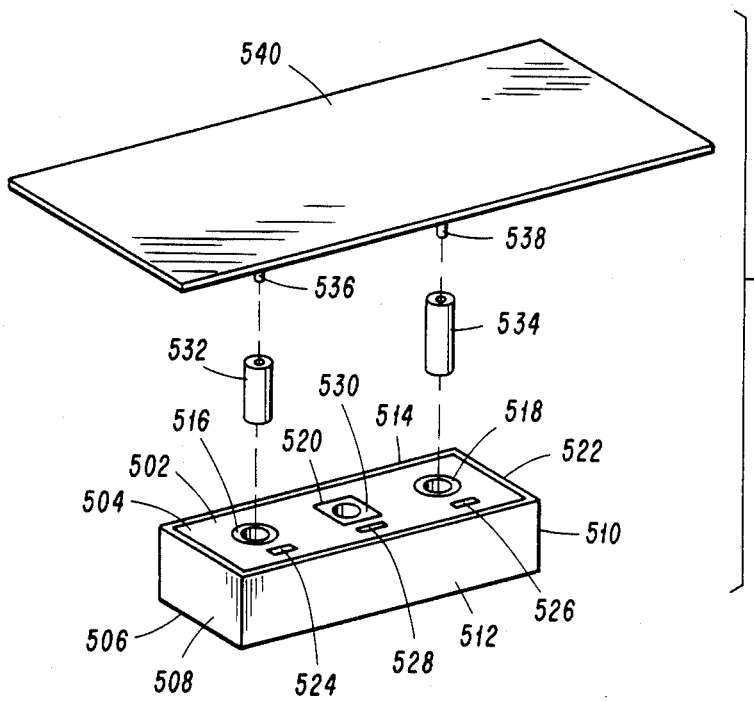
FIG. 5 is an exploded schematic representation of a monolithic homogeneous ceramic filter of an alternative embodiment of the present invention.

Referring now to the drawings, and more particularly to FIG. 1, there is shown an inhomogeneous ceramic filter of the prior art. This filter, generally designated 10, includes a first transverse electromagnetic (TEM) resonator 11, a second TEM resonator 12, a third TEM resonator 13, a fourth TEM resonator 14, a fifth TEM resonator 15, a first launching resonator 16, and a second launching resonator 17, all of said resonators are in a ceramic medium together and in a framework means 18 for fixing the resonators in a separated position so that air gaps such as 19 are located therebetween.

Now referring to FIG. 2, there is shown an exploded view of a monolithic inhomogeneous ceramic filter of the present invention, together with a typical circuit board. There is shown a filter generally designated 200 which includes a ceramic block 202 having a top side 204 and a bottom side 206 and three TEM resonator bore holes 208, 210 and 212 extending from side 204 through block 202 to side 206. Ceramic block 202 has a plurality of notches cut on each longitudinal side. These notches extend into block 202 and further extend from top side 204 to bottom side 206. The block 202 is given a metallic coating 214 on all surfaces including bore holes 208, 210 and 212, and excluding only top side 204 and the sides of the notches. The distance between topside 204 and bottom side 206 is a function of the desired frequency of the filter and is typically slightly less than $\frac{1}{4}$ wavelength.

Each of the three plated bore holes 208, 210 and 212 is electrically connected at the bottom side 206 and is not connected at the topside 204. The end bore holes 208 and 212 receive an insulating sleeve 224 and 226, respectively. Polytetra fluoroethylene or polystyrere are the preferred materials for construction of these sleeves. Sleeve 224 having a top end 228 and a bottom end 230 so that bottom end 230 is in planar alignment with bottom side 206 when sleeve 224 is inserted into bore hole 208 while top end 228 is in planar alignment with topside 204. Sleeve 226 having a top end 232 and a bottom end 234 is designed to be received by bore hole 212 in a manner similar to sleeve 224 and bore hole 208. Sleeve 224 at its top end 228 and sleeve 226 at its top end 232 are capable of receiving a capacitor probe 236 and 238, respectively, which are part of a circuit board 240. Probes 236 and 238 have a variable length with the input and output capacitive coupling being a function of the probe length.

In operation the filter 200 is capacitively coupled to the circuit board 240 by the capacitance produced by probes 236 and 238 in a separated juxtaposition with the metal coating 214 in bore holes 208 and 212, respectively, while the inter-resonator coupling is accomplished by the unplated notches 216, 218, 220, and 222.

Now referring to FIG. 3, there is shown an enlarged monolithic inhomogeneous ceramic dielectric filter of FIG. 2, generally designated 300 comprising a ceramic block 302 preferably having a high dielectric constant with $\rho$ in the range of 38. Two preferred ceramic materials are barium tetratitanate ($BaTi_4O_9$) and zirconium tin titanate ($ZrSn\ TiO_2$). Block 302 has a top side 304, bottom side 306, first end 308, second end 310, first side 312 and second side 314. Ceramic block 302 has a metal coating 316 placed on all surfaces excluding top side 304, which may be comprised of any electrically conductive material with a copper alloy being preferred. First side 312 having a first side first notch 318 and a first side second notch 320 therein. Notches 318 and 320 being preferably created by removing a portion of the ceramic block 302. These notches are for providing inter-resonator coupling and their size, dimension and shape will be variable depending upon the characteristics of the particular filter. If there are N resonators in the filter, there will be two sets of notches, one set on each side of the filter with each set preferably comprising N-1 notches. Second side 314 having a second side first notch 322 and a second side second notch 324 therein. Notches 322 and 324 are constructed similarly to notches 318 and 320. Block 302 has a first resonator hole 326, a second resonator hole 328 and a central resonator hole 330. Resonator holes 326, 328 and 330 extend from the top surface 304 of block 302 to the bottom surface 306, and are preferably created by drilling or boring a hole through the ceramic block 302.

The metallic coating 316 is present within each resonator hole 326, 328 and 330. Center resonator hole 330, has preferably a conductive pad 332 surrounding hole 330 on side 304 and in electrical contact with the metallic coating 316 found around the sides of hole 330. Pad 332 is to provide additional electrical length to the center resonator in order to compensate for the coupling capacitance on the end resonators. The size, shape and dimensions of pad 332 are variable depending upon the desired filtering characteristics. The notches 318, 320, 322 and 324 are cut into the block 302 and provide for coupling between the resonator tubes 326, 328 and 330. The distance between top side 304 and bottom side 306 is variable, and determines the frequency of the filter. Typically the distance between 304 and 306 is somewhat less than $\frac{1}{4}$ wavelength of the desired frequency.

Now referring to FIG. 4, there is shown a bottom view of the filter of FIG. 3. The filter, generally designated 400, is shown having a ceramic block 402, a top side 404, a bottom side 406, a first end 408, a second end 410, a first side 412 and a second side 414. Ceramic block 402 has a metal coating 416 on all surfaces except the top side 404. Furthermore, several notches are shown to have been cut through the metal coating 416 into the block 402 along sides 412 and 414. Ceramic block 402 is shown having three bore holes 426, 430 and 428, extending from top side 404 through block 402 to bottom side 406. Metallic coating 416 extends over the entire surface of bottom side 406 and through bore holes 426, 428 and 430.

Now referring to FIG. 5, there is shown an exploded view of a monolithic homogeneous dielectric filter of an alternative embodiment of this invention. The filter, generally designated 500, comprising a ceramic block 502 having a top side 504, a bottom side 506, a first end 508, a second end 510, a first side 512 and a second side 514. Ceramic block 502 has a first TEM resonator bore hole 516, a second TEM resonator bore hole 518, and a central TEM resonator bore hole 520. Bore holes 516, 518, and 520 extend through block 502 from top side 504 to bottom side 506, and are preferably created by drilling holes through the ceramic block 502. A metallic coating 522 covers all surfaces of ceramic block 502 including the sides of bore holes 516, 518 and 520, and excluding only top side 504. Top surface 504 further has a first capacitor pad 524, a second capacitor pad 526 and a central capacitor pad 528. These capacitor pads are to provide the capacitance typically associated with each resonator in a classic comb-line filter and their size, dimension, location and shape are variable, depending upon the desired characteristics of the filter 500. Surrounding central hole 520 on top side 504 is a conductor pad 530 which is electrically connected with the metallic coating 522 within hole 520. The size, shape and configuration of conductor pad 530 is variable depending upon the desired characteristics of the filter 500. The length of the first TEM resonator bore hole 516 and second TEM resonator bore hole 518 vary depending upon the desired characteristics of the filter 500, and are typically significantly shorter than $\frac{1}{4}$ wavelength of the desired frequency of filter 500. There is also shown a first TEM resonator bore hole insulating sleeve 532 and a second TEM resonator bore hole insulating sleeve 534. Sleeves 532 and 534 are for receiving capacitor probes 536 and 538, respectively, which engage circuit board 540.

In operation, the filter 500 is capacitively coupled to the circuit board 540 by the capacitance produced by capacitor probe 536 together with the metallic coating 522 in bore hole 516, and by capacitor probe 538 with the metallic coating 522 in bore hole 518. The electromagnetic coupling between resonators 516, 518 and 520 is achieved through the ceramic because the resonators are less than $\frac{1}{4}$ wavelength.

It is thought that the monolithic ceramic filters of the present invention, together with the method for producing such filters, and many of their attendant advantages, will be understood from the foregoing description, and it will be apparent that various changes may be made in the form, construction, and arrangement of the parts and steps thereof without departing from the spirit and scope of the invention, or sacrificing all of their material advantages, the form hereinbefore described being merely preferred or exemplary embodiments thereof.

We claim:

1. A monolithic ceramic dielectric RF filter comprising:

a. a single dielectric block having a top surface, a bottom surface, a first end, a second end, a front side, and a back side;

b. said dielectric block further having a plurality of resonator holes, for forming TEM resonators, spatially disposed at a predetermined distance from another extending from said top surface to said bottom surface;

c. said dielectric block further having a conductive material coating upon all surfaces including the sides of said plurality of resonator holes and excepting only portions of said top surface;

d. a first capacitor probe positioned within one of said plurality of resonator h holes and being capable of attachment to a circuit board;

e. a second capacitor probe positioned within another of said plurality of resonator holes and being capable of attachment to a circuit board;

f. a first cylindrical insulator sleeve interposed between said first capacitor probe and said one of said resonator holes;

g. a second cylindrical insulator sleeve interposed between said second capacitor probe and said another of said resonator holes; and h. a conductor pad formed on said top surface and surrounding all of said plurality of resonator holes excepting said one of said plurality of resonator holes and said another of said plurality of resonator holes, and further being in electrical contact with said conductive material coating, for creating an elongated current path.

* * * * *